United States Patent [19]

Berglund

[11] 4,453,644

[45] Jun. 12, 1984

[54] CAP WITH TEAR-OFF TAG

[75] Inventor: Jan Berglund, Västra Frölunda, Sweden

[73] Assignee: Wicanders AB, Sweden

[21] Appl. No.: 453,892

[22] PCT Filed: May 7, 1982

[86] PCT No.: PCT/SE82/00157

§ 371 Date: Dec. 13, 1982

§ 102(e) Date: Dec. 13, 1982

[87] PCT Pub. No.: WO82/03837

PCT Pub. Date: Nov. 11, 1982

[30] Foreign Application Priority Data

May 8, 1981 [SE] Sweden ..... 8102899

[51] Int. Cl.[3] ..... B65D 41/42

[52] U.S. Cl. ..... 215/255

[58] Field of Search ..... 215/255, 304; 220/270

[56] References Cited

U.S. PATENT DOCUMENTS

| | | | |
|---|---|---|---|
| 1,239,238 | 9/1917 | White . | |
| 1,549,080 | 8/1925 | Henson | 215/304 |
| 2,778,520 | 1/1957 | Hyde, Jr. | 215/253 |
| 3,743,129 | 7/1973 | Willis et al. . | |
| 3,958,710 | 5/1976 | Harding et al. | 215/254 |
| 4,003,488 | 1/1971 | Moller | 215/254 |
| 4,227,619 | 10/1980 | Magnusson | 215/255 |

FOREIGN PATENT DOCUMENTS

| | | |
|---|---|---|
| 2456695 | 6/1976 | Fed. Rep. of Germany . |
| 2268708 | 11/1975 | France . |
| 417417 | 3/1981 | Sweden . |

*Primary Examiner*—Donald F. Norton

*Attorney, Agent, or Firm*—Brumbaugh, Graves, Donohue & Raymond

[57] ABSTRACT

Cap (1) with tear-off tag having a pulling member in the form of a ring or eye connected to the tear-off tag. The cap is characterized by at least one upset buckling or impression (5, 6) extending over the pulling member (4) and the outer part of the tear-off tag (2) connected to the pulling member.

2 Claims, 4 Drawing Figures

CAP WITH TEAR-OFF TAG

Figure 1:
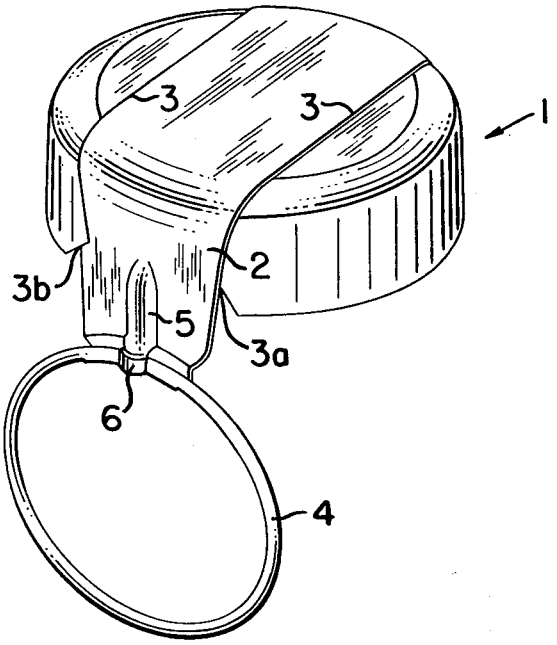

The present invention relates to a cap with tear-off tag having a pulling member in the form of a ring or eye connected to the tear-off tag.

Caps of the type described above are already known through our Swedish patent application No. 78 02 184-7, for example.

Since opening means provided with pulling rings or eyes have become extremely popular for containers of the can type which are opened by pulling the opening means in an upward direction, it has proved difficult to get the consumer to handle pulling rings or eyes on cap for containers in any other way than by pulling straight upwards. This may cause problems in opening caps sealing the opening of a bottle, since the "correct" method of opening these is first to pull the pulling ring straight out across the longitudinal direction of the bottle and only thereafter pull the ring upwards. During the initial pull in transverse direction, the weakened sections of the material defining the tear-off tag itself will properly give way simultaneously on both sides of the tear-off tag. Since this initial pull on the tag demands a good grip for the weakened sections to give way and permit the cap to be opened it has been proposed according to the Swedish patent application mentioned above to use a pulling ring or eye connected to the tear-off tag. However, it has been found that, as in the case of pulling rings for opening cans, the ring is pulled straight upwards even when removing the cap from a bottle. There is then a considerable risk that the tear-off tag will not come loose from the rest of the cap in the correct manner, i.e. the tear-off tag may break off, or it is even possible that the pulling ring itself may break off from the tag if the tear-off tag and pulling ring have been made as two separate components and then joined together.

Another drawback with known caps of the type in question is the deformation of tear-off tag and pulling member which may occur when handling the cap prior to its application on the bottle or container. The tag part protruding from the cap may also be deformed, for instance, when the sealed bottles are packed in crates or the like for transport.

The primary object of the present invention is to achieve a cap with a tear-off tag having a pulling ring or eye connected to the tag, which can be opened in a simple manner by pulling the ring or eye in an upward direction, without the risk of the ring or eye unintentionally coming loose from the tag—in the event of the tag and ring or eye consisting of two separate components which have been joined together.

Another object of the present invention is to achieve a cap of the type described in which the protruding tag-end has considerably greater resistance to deformation during sorting and transportation of the cap to the place of use.

Yet another object of the present invention is to achieve a cap of the type described where the pulling ring or eye is shaped to fit the neck of a bottle, for instance, thus making unintentional interference with the opening components of the cap more difficult when the capped bottle is placed in a crate, for instance.

Yet another object of the present invention is to achieve a cap of the type described above, where a force component acting transversely to the direction of pull is in any case obtained when the ring or eye is pulled straight up.

The above objects are achieved according to the invention in that the cap is given the features defined in the claims.

By arranging at least one upset buckling or impression extending over the pulling member and the outer part of the tear-off tag connected to the pulling member, the tear-off tag itself is reinforced, at the same time as the buckling or impression on the pulling member is rolled up over the buckling or impression on the tear-off tag when the pulling member is bent from folded down to folded up position. When the pulling member is then pulled straight up, leverage will be produced between the pulling member and the junction of the tear-off tag with the cap so that a bending torque is exerted on the tear-off tag when pulling of the pulling member is initiated. This bending torque considerably facilitates a correctly initiated separation of the tear-off tag from the rest of the cap.

Said bending torque can be intensified by making the pulling member curved, thus giving rise to a transverse force operating against the pulling direction, this force, due to a relatively long leverage, also giving rise to a bending torque acting on the tear-off tag.

Figure 2:
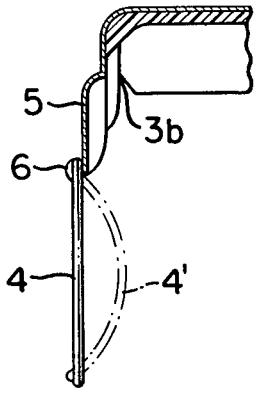
Figure 3:
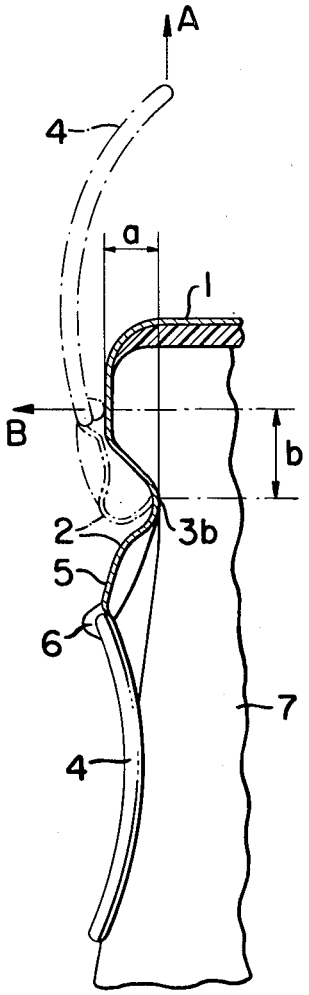
Figure 4:
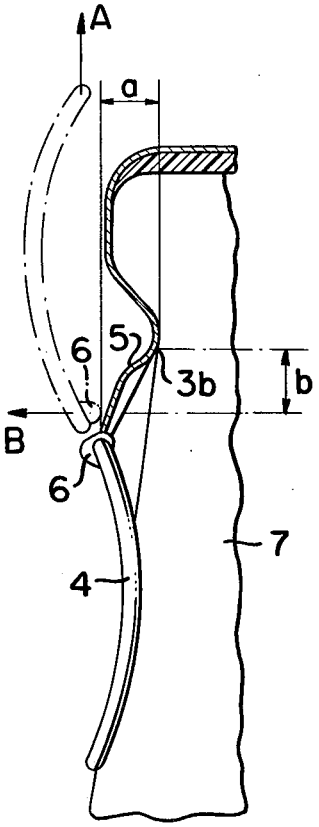

The invention will now be described with reference to embodiments shown in the accompanying drawings, in which FIG. 1 shows in perspective a cap according to the invention before being placed on a bottle opening, for instance, FIG. 2 shows a vertical section through a part of the cap according to FIG. 1, and the cooperating pulling member when folded down, FIG. 3 shows a side view in section, similar to FIG. 2, but with the cap placed on the neck of a bottle and the pulling member lifted from its normal full line position to the dotted line position in which the lower end of the tear-off tag is rolled up and separation of the latter from the rest of the cap is about to be initiated; and FIG. 4 is a side view in section, similar to FIG. 3, but where the pulling member has first been turned up from its normal downwardly extending full line position to the dotted line upwardly extending position before being pulled upwardly to separate the tear-off tag from the cap.

The cap 1 shown in FIG. 1 is provided with a tear-off tag 2 defined by weakened parts of the material 3 running straight across the cap. Removal of the tag 2 from the cap 1 is initiated by the sections 3, weakened by punching or the like, starting to tear at the annular portion of the cap 1, i.e. at the points marked **3*a* and 3*b* in FIG. 1** when the pulling member is pulled.

A pulling member 4 in the form of a ring or eye is secured in any conventional manner at the lower end of the tear-off tag 2. Formed in the tear-off tag is an outwardly projecting impression or buckling according to the invention which extends downwardly from about the level of the tear points **3*a* and 3*b* and has at its lower end a portion 6 lying over the ring 4** and projecting outwardly therefrom.

FIG. 2 shows the cap with pulling member 4 folded down, prior to application on a bottle, for instance.

The pulling member 4 is preferably given a curved appearance 4', as indicated by the dotted lines in FIG. 2.

In FIG. 3 the pulling member 4, shown here in the curved embodiment, has been pulled upwardly up to a position shown in dotted lines where separation of the tag 2 from the rest of the cap 1 has been initiated. The pulling member 4 is brought to the position shown in FIG. 3 by first bending it to a position away from the bottle and then pulling it upwardly to the vertical position. This causes the tag 2 to bend just above the impression 5 in the tag 2 and to partially roll up the lower end of the tear-off tag as shown in the Figure. During this folding/pulling upwards of the pulling member/tear-off tag, the initial tearing of the tear-off tag is started. When the impression 6 in the pulling member 4 has reached the annular portion of the cap, leverage a is produced between the contact point of the projecting impression portion 6 against the annular portion of the cap (in fact of the tear-off tag) and the weakened sections 3*a* and 3*b*. An upward pulling force in the pulling member 4, acting at the outer end of the lever arm a gives rise to a bending torque acting on the weakened sections 3*a* and 3*b* causing separation of the tear-off tag 2 from the rest of the cap 1.

By making the pulling member curved, an upward pulling force A on the pulling member will also give rise to a force component B acting transversely to the pulling direction, said force effecting a bending torque, acting at the lever arm b. These two bending torques obtained from the forces A and B and the lever arms a and b, considerably facilitate tearing off the tag along the score lines 3 in the cap 1.

If the pulling member 4 is "turned" up from the full line position to the dotted line position shown in FIG. 4 with the projection impression portion 6 rolled over the lower end of the impression 5 an upwardly directed pulling force A on the pulling member will complete the separation of the tear-off tag 2 from the rest of the cap. Two bending torques are thus obtained—due to the forces A acting at B and the lever arms a and b, respectively,—which, as in the case of FIG. 3, facilitate removal of the tear-off tag 2.

In FIGS. 3 and 4 the upset buckling or impression in the tear-off flap has been especially shown in different sizes, the impression 5 in FIG. 3 being somewhat deeper than the corresponding impression in FIG. 4. Thus, by making the depth and number of the impressions dependent on the cap material, width of tear-off tag, etc., it is possible to achieve operation as illustrated in FIG. 3 or in FIG. 4.

The invention is not limited to the embodiments described above. Modifications are possible within the scope of the following claims.

I claim:

1. A tear tab closure for containers comprising a cap having a top wall, a downwardly depending skirt and score lines in the skirt and top wall defining a tear-off strip adapted to be torn out to open the closure, in which the improvement comprises a straight tear-off tag formed on said tear-off strip and extending downwardly from the skirt, and a separate pull ring secured at the bottom end of said tear-off tag, said tear-off tag having formed therein an outwardly projecting impression extending downwardly from about the level of the bottom of said skirt to said pull ring and formed at its lower end with a portion projecting outwardly from said pull ring, said portion being arranged to be moved into contacting relation to the outer surface of said impression when said ring is raised to fold it over said tear-off tag to establish a lever arm, to one end of which force is applied when said pull ring is raised to remove the tear strip, whereby tearing of said tear strip from the cap is facilitated.

2. A tear tab closure as described in claim 1 in which the pull ring is curved so as to exert a force having a component transverse to said cap when the pull ring is pulled upwardly.

* * * * *